US007471278B2

(12) United States Patent
Ito

(10) Patent No.: US 7,471,278 B2
(45) Date of Patent: Dec. 30, 2008

(54) DISPLAY DRIVER, ELECTRO-OPTICAL DEVICE, AND DRIVE METHOD

(75) Inventor: Satoru Ito, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 671 days.

(21) Appl. No.: 10/954,051

(22) Filed: Sep. 30, 2004

(65) Prior Publication Data

US 2005/0093810 A1 May 5, 2005

(30) Foreign Application Priority Data

Oct. 10, 2003 (JP) ..... 2003-352649

(51) Int. Cl.
*G09G 3/36* (2006.01)

(52) U.S. Cl. ..... 345/100; 345/87; 345/204

(58) Field of Classification Search ..... 345/76–100, 345/204, 60, 74.1, 75.1, 75.2, 214
See application file for complete search history.

(56) References Cited

U.S. PATENT DOCUMENTS 4,926,166 A 5/1990 Fujisawa et al.
5,592,191 A * 1/1997 Tsuboyama et al. ..... 345/97
6,356,314 B1 * 3/2002 Takebe ..... 348/564
2002/0190973 A1 12/2002 Morita
2005/0062878 A1 3/2005 Ito
2005/0093811 A1 5/2005 Ito

FOREIGN PATENT DOCUMENTS

JP A 09-006278 1/1997
JP A 2001-305510 10/2001
JP A 2002-351412 12/2002

* cited by examiner

*Primary Examiner*—Richard Hjerpe
*Assistant Examiner*—Mansour M Said
(74) *Attorney, Agent, or Firm*—Oliff & Berridge, PLC

(57) ABSTRACT

A display driver which drives at least a plurality of scan lines of a liquid crystal device which has a plurality of data lines and a plurality of pixels in addition to the scan lines, the display driver including a plurality of scan drive cells; a plurality of scan order registers; and a plurality of coincidence detection circuits. Each of the scan drive cells drives one of the scan lines. Each of the scan order registers is connected to one of the coincidence detection circuits, and stores a scan order address which is used to show a scan order. Each of the coincidence detection circuits is connected to one of the scan drive cells, and outputs a result of comparison of the scan order address stored in each of the scan order registers with a scan line address designated by a scan control signal, to one of the scan drive cells.

19 Claims, 14 Drawing Sheets

DISPLAY DRIVER, ELECTRO-OPTICAL DEVICE, AND DRIVE METHOD

Japanese Patent Application No. 2003-352649, filed on Oct. 10, 2003, is hereby incorporated by reference in its entirety.

BACKGROUND OF THE INVENTION

The present invention relates to a scan driver, an electro-optical device, and a drive method.

A liquid crystal panel is used as a display section of an electronic instrument such as a portable telephone. In recent years, a still image and a video image which are valuable as information have been distributed accompanying widespread use of portable telephones, and an increase in the image quality of the liquid crystal panel has been demanded.

An active matrix type liquid crystal panel using a thin-film transistor (hereinafter abbreviated as "TFT") is known as a liquid crystal panel which realizes an increase in the image quality of a display section of an electronic instrument. The active matrix type liquid crystal panel using the TFT realizes high response time and high contrast in comparison with a simple matrix liquid crystal panel using a dynamically driven super twisted nematic (STN) liquid crystal, and is suitable for displaying a video image or the like (see Japanese Patent Application Laid-open No. 2002-351412).

However, since the active matrix type liquid crystal panel using the TFT consumes a large amount of electric power, power consumption must be reduced in order to employ the active matrix type liquid crystal panel as a display section of a battery-driven portable electronic instrument such as a portable telephone. An interlaced drive is known to reduce power consumption. A comb-tooth drive which reduces a coloring error of each display pixel is also known. The interlaced drive is a drive method suitable for displaying a still image, since the image quality is decreased when applied to a video image.

Therefore, a driver circuit which can deal with various drive methods such as a normal drive, interlaced drive, and comb-tooth drive is demanded for a display panel (liquid crystal panel, for example) which displays a still image and a video image.

BRIEF SUMMARY OF THE INVENTION

According to one aspect of the present invention, there is provided a display driver which drives at least a plurality of scan lines of a display panel which has a plurality of data lines and a plurality of pixels in addition to the scan lines, the display driver comprising:

a plurality of scan drive cells;

a plurality of scan order registers; and a plurality of coincidence detection circuits, wherein:

each of the scan drive cells drives one of the scan lines;

each of the scan order registers is connected to one of the coincidence detection circuits, and stores a scan order address which is used to show a scan order; and each of the coincidence detection circuits is connected to one of the scan drive cells, and outputs a result of comparison of the scan order address stored in each of the scan order registers with a scan line address designated by a scan control signal, to one of the scan drive cells.

According to another aspect o the present invention, there is provided a method of driving at least a plurality of scan lines of a display panel by using a plurality of scan drive cells, the display panel having a plurality of data lines and a plurality of pixels in addition to the scan lines, the method comprising:

designating a scan line address by a scan control signal;

storing a scan order address which is used to show a scan order in each of scan order registers;

comparing the scan order address with the scan line address, and outputting the comparison result to the scan drive cells; and driving the scan lines by the scan drive cells.

DETAILED DESCRIPTION OF THE EMBODIMENTS

Figure 1:
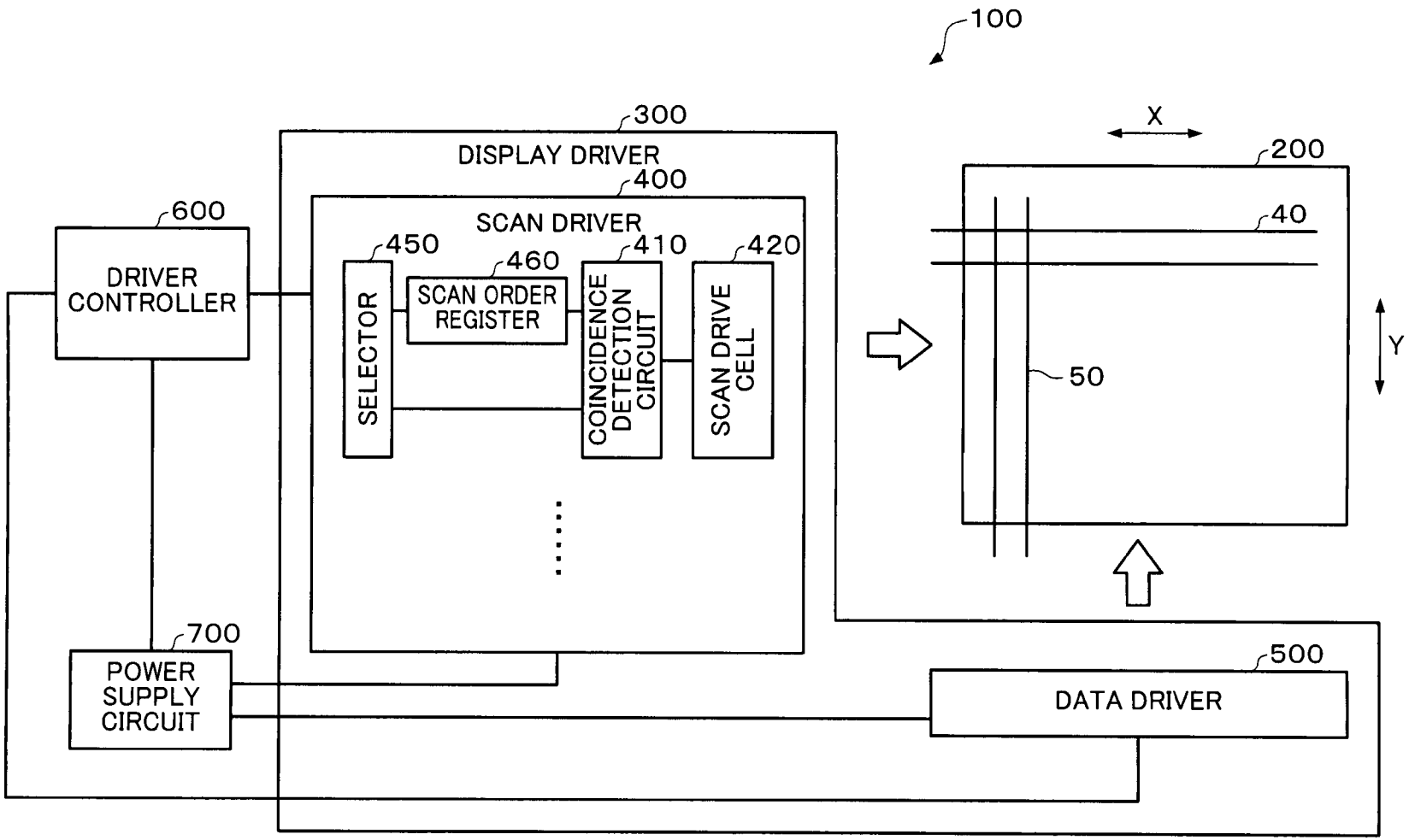
FIG. 1 is a diagram schematically showing an electro-optical device according to one embodiment of the present invention.

Embodiments of the present invention are described below.

According to one embodiment of the present invention, there is provided a display driver which drives at least a plurality of scan lines of a display panel which has a plurality of data lines and a plurality of pixels in addition to the scan lines, the display driver comprising:

a plurality of scan drive cells;

a plurality of scan order registers; and a plurality of coincidence detection circuits, wherein:

each of the scan drive cells drives one of the scan lines;

each of the scan order registers is connected to one of the coincidence detection circuits, and stores a scan order address which is used to show a scan order; and each of the coincidence detection circuits is connected to one of the scan drive cells, and outputs a result of comparison of the scan order address stored in each of the scan order registers with a scan line address designated by a scan control signal, to one of the scan drive cells.

In this display driver, the scan lines can be driven in an arbitrary order by writing the scan order into the scan order register corresponding to the scan drive cell. This enables the display driver to flexibly deal with various drive methods.

This display driver may further comprise: a scan line address bus used to supply the scan line address; and a scan order address bus used to supply the scan order address to each of the scan order registers. This enables the scan order to be written into the scan order registers.

In this display driver, each of the scan order registers may store the scan order address from the scan order address bus, based on a write clock signal. This enables the scan order to be written into the scan order registers.

This display driver may further comprise a plurality of selectors each of which is connected to one of the scan order registers, wherein each of the selector may select the scan order address bus from among the scan order address bus and the scan line address bus, and output the scan order address from the selected scan order address bus to one of the scan order registers connected to the selector when storing the scan order address in the scan order register. This enables to select one of the scan order address bus and the scan line address bus. Moreover, the selector can supply the scan line address supplied from the scan order address bus to the coincidence detection circuit. Furthermore, the selector can supply the scan order address supplied from the scan order address bus to the scan order register.

In this display driver, when one of the coincidence detection circuits determines that the scan line address coincides with the scan order address, one of the scan drive cells connected to the coincidence detection circuit may drive one of the scan lines connected to the scan drive cell. This enables the scan drive cell corresponding to the scan line address to be driven. Therefore, the scan line to be ON-driven can be selected from among the scan lines.

In this display driver, the scan line address may be set to an address other than the scan order address when none of the scan lines are selected. This prevents all the scan lines from being driven. Moreover, the display panel can be driven without major change of the circuit of the display driver, even if the number of scan lines in the display panel is smaller than the number of scan drive cells in the display driver.

In this display driver, the scan order addresses may be sequentially stored into the scan order registers; and the scan lines may be sequentially driven by incrementing or decrementing the scan line addresses. This makes it possible to deal with the sequential drive.

In this display driver, the scan order addresses may be stored into the scan order registers in an order corresponding to a scan order for interlaced driving; and the scan lines may be interlaced-driven by incrementing or decrementing the scan line addresses. This makes it possible to deal with the interlaced drive.

In this display driver, the scan order address may be stored into the scan order registers in an order corresponding to a scan order for comb-tooth driving; and the scan lines may be comb-tooth driven by incrementing or decrementing the scan line addresses. This makes it possible to deal with the comb-tooth drive.

In this display driver, each of the coincidence detection circuits may have at least one of an output enable input and an output fix input; each of the coincidence detection circuits may ON-drive one of the scan drive cells connected to the coincidence detection circuit in a period in which an active signal is input to the output fix input of the coincidence detection circuit; and each of the coincidence detection circuits may OFF-drive one of the scan drive cells connected to the coincidence detection circuit in a period in which a non-active signal is input to the output enable input of the coincidence detection circuit. This enables the scan drive cells to be ON-driven or OFF-driven independent of the scan line address.

According to one embodiment of the present invention, there is provided an electro-optical device comprising:

the above-described display driver;

a display panel driven by the display driver; and a controller which controls the display driver.

According to one embodiment of the present invention, there is provided a method of driving at least a plurality of scan lines of a display panel by using a plurality of scan drive cells, the display panel having a plurality of data lines and a plurality of pixels in addition to the scan lines, the method comprising:

designating a scan line address by a scan control signal;

storing a scan order address which is used to show a scan order in each of scan order registers;

comparing the scan order address with the scan line address, and outputting the comparison result to the scan drive cells; and driving the scan lines by the scan drive cells.

This enables the scan lines to be driven in an arbitrary order.

In this drive method, the scan line address may be set to an address other than the scan order address when none of the scan lines are selected. This prevents all the scan lines from being driven.

These embodiments of the present invention are described below in detail with reference to the drawings. Note that the embodiments described below do not in any way limit the scope of the invention laid out in the claims herein. In addition, not all of the elements of the embodiments described below should be taken as essential requirements of the present invention.

1. Electro-Optical Device

FIG. 1 schematically shows an electro-optical device including a display driver according to one embodiment of the present invention. FIG. 1 shows a liquid crystal device as an example of an electro-optical device. A liquid crystal device 100 may be incorporated into various electronic instruments such as a portable telephone, portable information instrument (such as PDA), wearable information instrument (such as wrist watch type terminal), digital camera, projector, portable audio player, mass storage device, video camera, on-board display, on-board information terminal (car navigation system or on-board personal computer), electronic notebook, or global positioning system (GPS).

The liquid crystal device 100 includes a display panel (optical panel) 200, a display driver 300, a driver controller 600, and a power supply circuit 700. The display driver 300 includes a scan driver (gate driver) 400 and a data driver (source driver) 500. The scan driver 400 includes a coincidence detection circuit 410, a scan drive cell 420, a selector 450, and a scan order register 460. The details of the scan driver 400 are described later.

The liquid crystal device 100 does not necessarily include all of these circuit blocks. The liquid crystal device 10 may have a configuration in which some of the circuit blocks are omitted. The data driver 500 in this embodiment may be disposed outside the display driver 300. The display driver 300 may be configured to include the driver controller 600. In FIG. 1, the selector 450 and the scan order register 460 are included in the scan driver 400. However, the selector 450 or the scan order register 460 may be disposed outside the scan driver 400.

In the drawings, components denoted by the same reference numbers have the same meanings.

The display panel 200 includes a plurality of scan lines (gate lines) 40, a plurality of data lines (source lines) 50 which intersect the scan lines 40, and a plurality of pixels, each of the pixels being specified by one of the scan lines 40 and one of the data lines 50. In the case where one pixel consists of three color components of RGB, one pixel consists of three dots, one dot each for R, G, and B. The dot may be referred to as an element point which makes up each pixel. The data line 50 corresponding to one pixel may be referred to as the data lines 50 in the number of color components which make up one pixel. The following description is appropriately given on the assumption that one pixel consists of one dot for convenience of illustration.

Each pixel includes a thin-film transistor (hereinafter abbreviated as "TFT") (switching device in a broad sense), and a pixel electrode. The TFT is connected with the data line 50, and the pixel electrode is connected with the TFT.

The display panel 200 is formed by a panel substrate such as a glass substrate. The scan lines 40 formed along the row direction X shown in FIG. 1 and the data lines 50 formed along the column direction Y shown in FIG. 1 are arranged so that the pixels arranged in a matrix can be appropriately specified. The scan lines 40 are connected with the scan driver 400. The data lines 50 are connected with the data driver 500.

The scan driver 400 drives a desired scan line 40 according to a control signal from the driver controller 600. This enables this embodiment to deal with various scan drive methods. As the scan drive method, a normal drive (sequential drive), a comb-tooth drive, an interlaced drive, and the like can be given.

2. Configuration of Scan Driver

Figure 2:
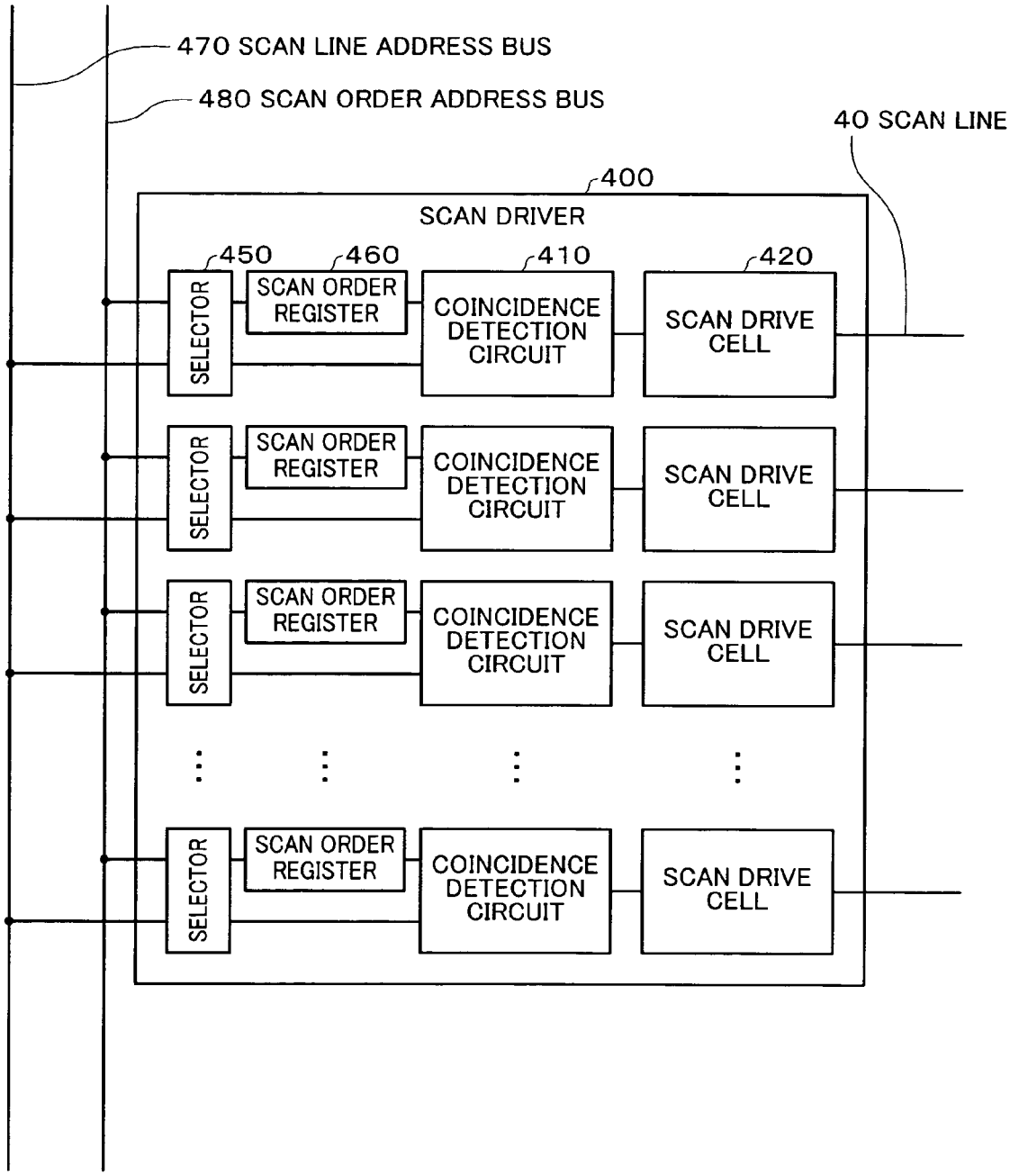
FIG. 2 is a block diagram showing a scan driver according to one embodiment of the present invention.

FIG. 2 shows the scan driver 400. The scan driver 400 includes a plurality of selectors 450, a plurality of scan order registers 460, a plurality of coincidence detection circuits 410, and a plurality of scan drive cells 420.

Each of the selectors 450 is connected with a scan line address bus 470 and a scan order address bus 480. Each of the selectors 450 is connected with the scan order register 460. Each of the scan order registers 460 is connected with the coincidence detection circuit 410. Each of the coincidence detection circuits 410 is connected with the scan drive cell 420. Each of the scan drive cells 420 drives at least one scan line 40.

A scan order is written into each of the scan order registers 460 at the time of initialization (at the time of power on, for example). In this embodiment, since 240 scan lines 40 are driven, an 8-bit value is stored in each of the scan order registers 460. The number of bits stored in each of the scan order registers 460 may be appropriately determined corresponding to the number of the scan lines 40. This embodiment is only an example, and the number of the scan lines 40 is not limited.

A scan order address which indicates the scan order is supplied to the scan order address bus 480 from an external control device at the time of initialization. The selector 450 selects the scan order address bus 480, and supplies the scan order address to the scan order register 460. This causes the scan order address to be written into the scan order register 460.

Each of the selectors 450 selects the scan line address bus 470 when driving the scan line 40. Each of the selectors 450 supplies the scan line address supplied to the scan line address bus 470 to the corresponding coincidence detection circuit 410. Each of the coincidence detection circuits 410 compares the scan order in the scan order register 460 with the scan line address supplied from the selector 450, and outputs the comparison result to the corresponding scan drive cell 420. Each of the scan lines 40 is driven in the order corresponding to a desired drive method (sequential drive, interlaced drive, or comb-tooth drive, for example).

3. Details of Scan Driver

Figure 3:
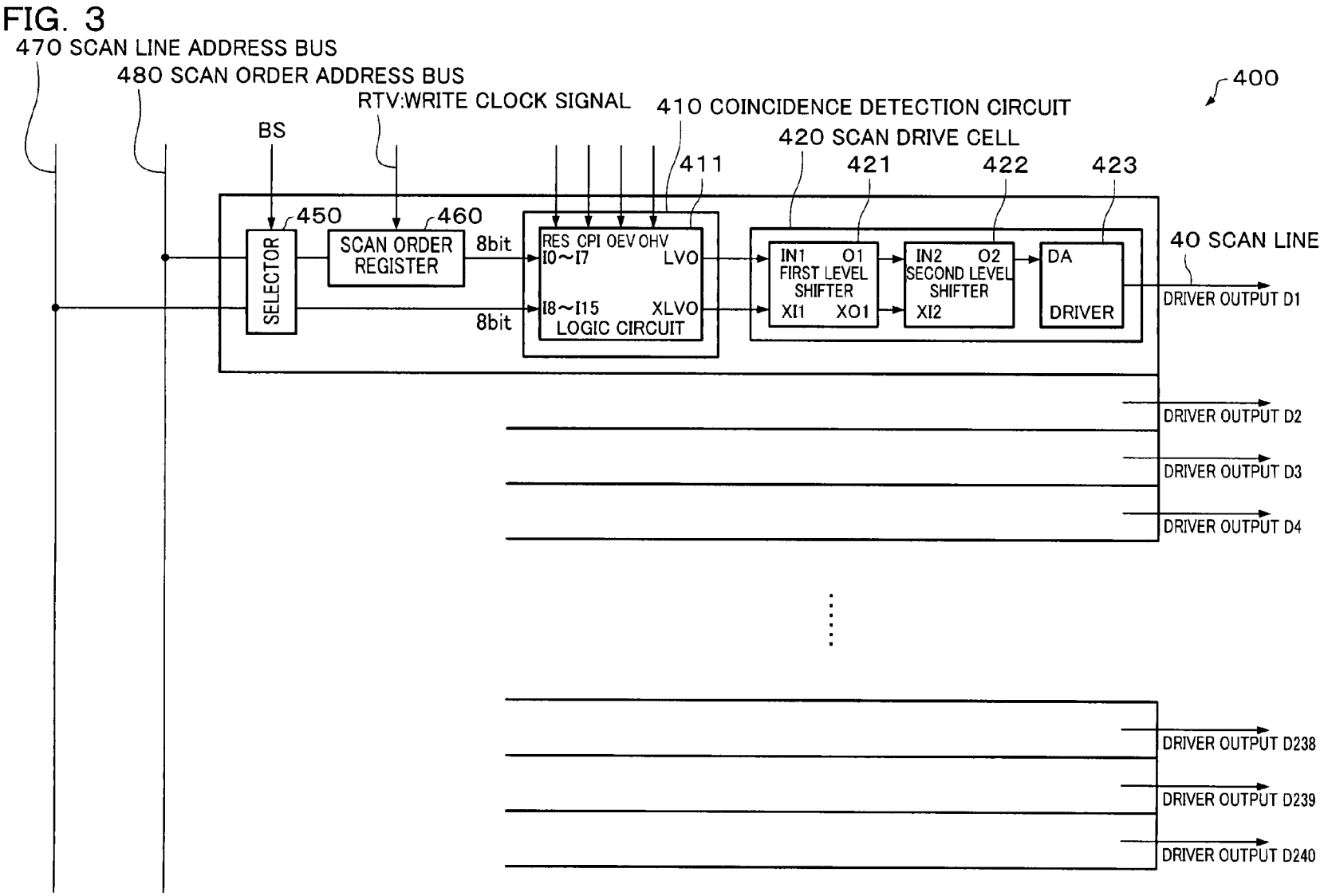
FIG. 3 is a diagram showing in detail a scan driver according to one embodiment of the present invention.

FIG. 3 shows the scan driver 400 in detail. In this embodiment, the scan driver 400 includes driver outputs D1 to D240 in order to drive the 240 scan lines 40.

The selector 450 is described below. The selector 450 is connected with the scan line address bus 470 and the scan order address bus 480. The selector 450 selects either the scan line address bus 470 or the scan order address bus 480 in response to a select signal BS input to the selector 450.

When the selector 450 selects the scan order address bus 480, the selector 450 supplies the scan order address supplied from the scan order address bus 480 to the scan order register 460. When the selector 450 selects the scan line address bus 470, the selector 450 supplies the scan line address supplied from the scan line address bus 470 to the coincidence detection circuit 410.

The scan order register 460 is described below. The scan order register 460 stores the scan order address supplied from the selector 450 in synchronization with the rising edge of a write clock signal RTV. When the selector 450 selects the scan line address bus 470, the scan order register 460 supplies the scan order address stored therein to the coincidence detection circuit 410.

In this embodiment, the select signal BS and the write clock signal RTV are controlled by the driver controller 600. However, the select signal BS and the write clock signal RTV may be controlled by another external control device.

The coincidence detection circuit 410 is described below. Each of the coincidence detection circuits 410 includes a logic circuit 411. The logic circuit 411 includes inputs I0 to I15 (N inputs in a broad sense). The logic circuit 411 includes a reset input RES, a scan clock input CPI, an output enable input OEV, an output fix input OHV, a logic circuit output LVO, and a logic circuit output XLVO. The scan order address from the scan order register 460 is input to the inputs I0 to I7 of the logic circuit 411 in bit units. The inputs I0 to I7 correspond to 8-bit data. The inputs I0 to I7 can be changed corresponding to the number of the scan lines 40 in the same manner as the number of bits of the scan order address which is determined corresponding to the number of the scan lines 40.

The scan line address supplied from the selector 450 is input to the inputs I8 to I15 of the logic circuit 411 in bit units. The inputs I8 to I15 correspond to 8-bit data. The inputs I8 to I15 can be changed corresponding to the number of the scan lines 40 in the same manner as the number of bits of the scan line address which is determined corresponding to the number of the scan lines 40.

When a signal at the "L" level is input to the reset input RES of the logic circuit 411, data in a register (flip-flop) in the logic circuit 411 is reset, and the coincidence detection circuit 410 OFF-drives (drives at non-active) the scan drive cell 420. In this embodiment, OFF-drive means that the target scan drive cell is unselect-driven, and ON-drive means that the target scan drive cell is select-driven. A scan synchronization pulse (scan clock signal CPV) is input to the scan clock input CPI. The coincidence detection circuit 410 always OFF-drives (drives at non-active) the scan drive cell 420 in a period in which a signal at the "L" level (non-active) is input to the output enable input OEV of the logic circuit 411. The coincidence detection circuit 410 always ON-drives (drives at active) the scan drive cell 420 in a period in which a signal at the "L" level (active) is input to the output fix input OHV of the logic circuit 411. The drive of the scan line 40 can be controlled without destroying the data retained in the register (flip-flop) in the logic circuit 411 by using at least one of the output enable input OEV and the output fix input OHV. The logic circuit 411 includes the logic circuit outputs LVO and XLVO from which a drive signal is output to the scan drive cell 420. The logic circuit output LVO outputs either a signal which ON-drives (drives at active) the scan drive cell 420 or a signal which OFF-drives (drives at non-active) the scan drive cell 420. The logic circuit output XLVO outputs a signal generated by reversing the signal output from the logic circuit output LVO.

The scan drive cell 420 is described below. The scan drive cell 420 includes a first level shifter 421, a second level shifter 422, and a driver 423. The first level shifter 421 includes first level shifter inputs IN1 and XI1 and first level shifter outputs O1 and XOI. The logic circuit output LVO is connected with the first level shifter input IN1, and the logic circuit output XLVO is connected with the first level shifter input XI1.

The second level shifter 422 includes second level shifter inputs IN2 and XIN2 and second level shifter outputs O2 and XO2. The first level shifter output O1 is connected with the second level shifter input IN2, and the first level shifter output XO1 is connected with the second level shifter input XI2.

The driver 423 includes a driver input DA. The second level shifter output O2 is connected with the driver input DA of the driver 423. The scan line 40 is connected with the driver 423. The driver 423 drives (ON-drives or OFF-drives) the scan line 40 corresponding to the signal from the second level shifter output O2.

4. Coincidence Detection Circuit

Three types of operations (normal operation mode, normally ON drive, and normally OFF drive) of the logic circuit 411 in the coincidence detection circuit 410 are described below.

Figure 4:
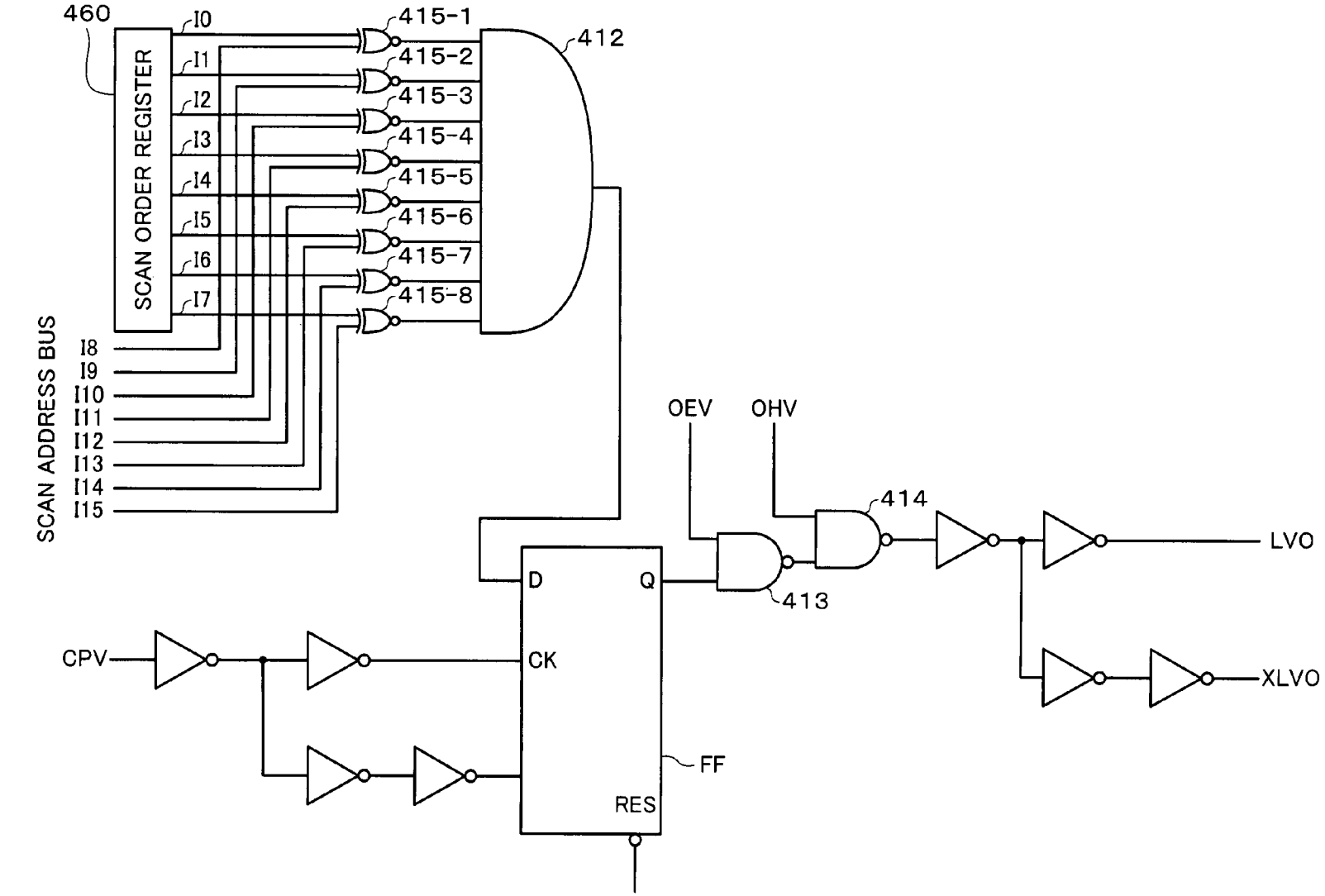
FIG. 4 is a circuit diagram showing a coincidence detection circuit according to one embodiment of the present invention.

FIG. 4 is a circuit diagram of the logic circuit 411. A numeral 412 denotes an eight-input AND circuit. Exclusive NOR (EX-NOR) sections 415-1 to 415-8 are connected with inputs of the eight-input AND circuit 412. Each of the exclusive NOR sections 415-1 to 415-8 includes two inputs. The scan order register 460 and the scan line address bus 470 are connected with the inputs of each of the exclusive NOR sections 415-1 to 415-8. The scan order register 460 is connected with the inputs I0 to I7 of the exclusive NOR sections 415-1 to 415-8, and the scan line address bus 470 is connected with the inputs I8 to I15 of the exclusive NOR sections 415-1 to 415-8. When the signal levels input to the two inputs coincide, each of the exclusive NOR sections 415-1 to 415-8 outputs a signal at the "H" level. Specifically, coincidence between the scan order register 460 and the scan line address bus 470 can be detected by each of the exclusive NOR sections 415-1 to 415-8. Numerals 413 and 414 denote NAND circuits. A symbol FF denotes a flip-flop circuit.

In the normal operation mode, a signal at the "H" level is input to the output enable input OEV of the NAND circuit 413, and a signal at the "H" level is input to the output fix input OHV of the NAND circuit 414. For example, when the outputs from the exclusive NOR sections 415-1 to 415-8 are signals at the "H" level and the output from the eight-input AND circuit 412 is at the "H" level, a signal at the "H" level is input to a D terminal of the flip-flop FF. The flip-flop FF latches the data (signal at "H" level) input to a D terminal in synchronization with the rising edge of the scan clock signal CPV input to a CK terminal of the flip-flop FF. A Q terminal of the flip-flop FF is set at the "H" level in a period in which the flip-flop FF latches the data (signal at "H" level). Since a signal at the "H" level is input to the output enable input OEV of the NAND circuit 413 and a signal at the "H" level is input to the output fix input OHV of the NAND circuit 414, a signal at the "H" level is output from the logic circuit output LVO of the logic circuit 411. A signal at the "L" level generated by reversing the signal output from the logic circuit output LVO is output from the logic circuit output XLVO.

When the output of the eight-input AND circuit 412 is at the "L" level, data for a signal at the "L" level is latched by the flip-flop FF, whereby a signal at the "L" level is output from the logic circuit output LVO.

A signal at the "L" level is input to the output fix input OHV during normally ON drive (when a signal at the "H" level is always output from the output LVO). Since the output from the NAND circuit 414 is at the "H" level independent of the output from the NAND circuit 413, the logic circuit output LVO is at the "H" level.

A signal at the "H" level is input to the output fix input OHV and a signal at the "L" level is input to the output enable input OEV during normally OFF drive (when a signal at the "L" level is always output from the output LVO). Since the output from the NAND circuit 413 is at the "H" level independent of the output from the Q terminal of the flip-flop FF, the output of the NAND circuit 414 is at the "L" level and the logic circuit output LVO is at the "L" level.

Specifically, the operation (normal operation mode, normally ON drive, and normally OFF drive) can be switched by controlling the signals supplied to the output enable input OEV and the output fix input OHV. When a signal at the "L" level is input to the output fix input OHV, the operation becomes normally OFF drive (signal at the "L" level is always output from the output LVO) independent of the signal input to the output enable input OEV.

5. Scan Drive Cell

The first level shifter 421 in the scan drive cell 420 is described below.

Figure 5:
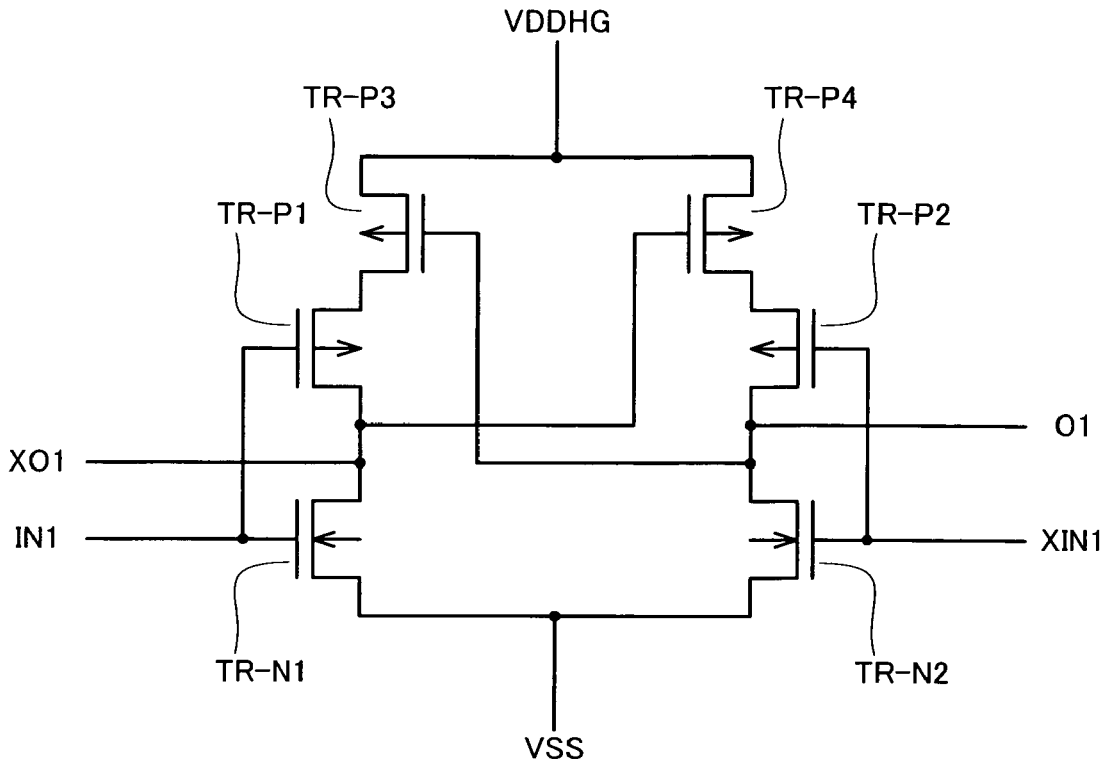
FIG. 5 is a circuit diagram showing the first level shifter in the scan drive cell shown in FIG. 3.

FIG. 5 is a circuit diagram of the first level shifter 421. The first level shifter 421 includes N-type transistors TR-N1 and TR-N2 (switching devices in a broad sense), and P-type transistors TR-P1 to TR-P4 (switching devices in a broad sense). The "H" level or the "L" level is exclusively input to the first level shifter inputs IN1 and XIN1. For example, when a signal at the "H" level is input to the first level shifter input IN1, a signal at the "L" level is input to the first level shifter input XIN1. The first level shifter outputs O1 and XO1 exclusively output the "H" level or the "L" level to the second level shifter 422. For example, when a signal at the "H" level is output from the first level shifter output O1, a signal at the "L" level is output from the first level shifter output XO1.

When the scan line address supplied to the scan line address bus 430 coincides with the scan order address stored in the scan order register 460, the output from the logic circuit output LVO in the coincidence detection circuit 410 is set at the "H" level. A signal at the "H" level is input to the first level shifter input IN1 of the first level shifter 421, and the output (signal at the "L" level in this case) from the logic circuit output XLVO is input to the first level shifter input XIN1.

In this case, the N-type transistor TR-N1 is turned ON, and the P-type transistor TR-P1 is turned OFF. This causes a voltage VSS to be output from the first level shifter output XO1. The N-type transistor TR-N2 is turned OFF, and the P-type transistor TR-P2 is turned ON. Since the voltage VSS is input to a gate input of the P-type transistor TR-P4, the P-type transistor TR-P4 is turned ON. As a result, a voltage VDDHG is output from the first level shifter output O1. When a signal at the "L" level is input to the first level shifter input IN1 and a signal at the "H" level is input to the first level shifter input XIN1, the P-type transistor TR-P1, the N-type transistor TR-N2, and the P-type transistor TR-P3 are turned ON. The N-type transistor TR-N1, the P-type transistor TR-P2, and the P-type transistor TR-P4 are turned OFF. Therefore, the voltage VDDHG is output from the first level shifter output XO1, and the voltage VSS is output from the first level shifter output O1.

The signals at the "H" level or the "L" level output to the first level shifter 421 are level-shifted to the signal level of the voltage VDDHG or the voltage VSS.

The second level shifter 422 is described below.

Figure 6:
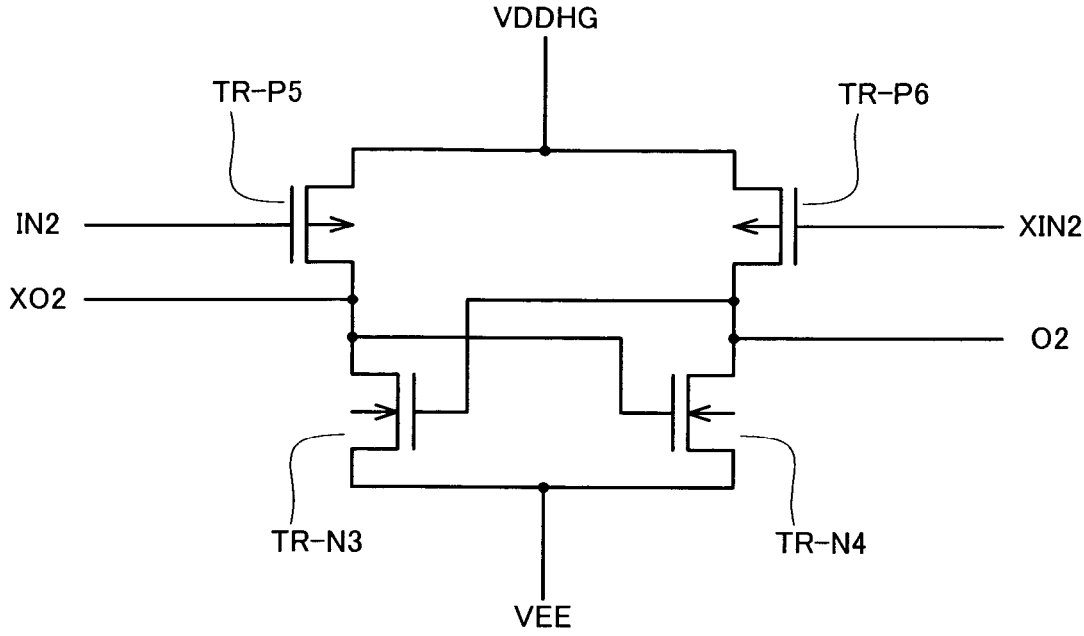
FIG. 6 is a circuit diagram showing the second level shifter in the scan drive cell shown in FIG. 3.

FIG. 6 is a circuit diagram of the second level shifter 422. The second level shifter 422 includes N-type transistors TR-N3 and TR-N4 and P-type transistors TR-P5 and TR-P6. The "H" level or the "L" level is exclusively input to the second level shifter inputs IN2 and XIN2. For example, when a signal at the "H" level is input to the second level shifter input IN2, a signal at the "L" level is input to the second level shifter input XIN2. The second level shifter outputs O2 and XO2 exclusively output the "H" level or the "L" level. For example, when a signal at the "H" level is output from the second level shifter output O2, a signal at the "L" level is output from the second level shifter output XO2.

When a signal at the voltage VDDHG is input to the second level shifter input IN2 of the second level shifter 422, a signal at the voltage VEE is exclusively input to the second level shifter input XIN2. In this case, the P-type transistor TR-P5 is turned OFF, and the P-type transistor TR-P6 is turned ON. This causes a signal at the voltage VDDHG to be output from the second level shifter output O2.

A signal at the voltage VDDHG is input to a gate of the N-type transistor TR-N3, whereby the N-type transistor TR-N3 is turned ON. This causes a voltage VEE to be output from the second level shifter output XO2.

When a signal at the voltage VDDHG is input to the second level shifter input XIN2 and a signal at the voltage VSS is input to the second level shifter input IN2; the P-type transistor TR-P5 is turned ON, and the P-type transistor TR-P6 is turned OFF. This causes a signal at the voltage VDDHG to be output from the second level shifter output XO2. A signal at the voltage VDDHG is input to a gate of the N-type transistor TR-N4, whereby the N-type transistor TR-N4 is turned ON. This causes a signal at the voltage VEE to be output from the second level shifter output O2.

Specifically, the signal at the voltage VSS input to the second level shifter input IN2 or XIN2 is level-shifted to the signal at the voltage VEE, and is output from the second level shifter output O2 or XO2.

The driver 423 is described below.

Figure 7:
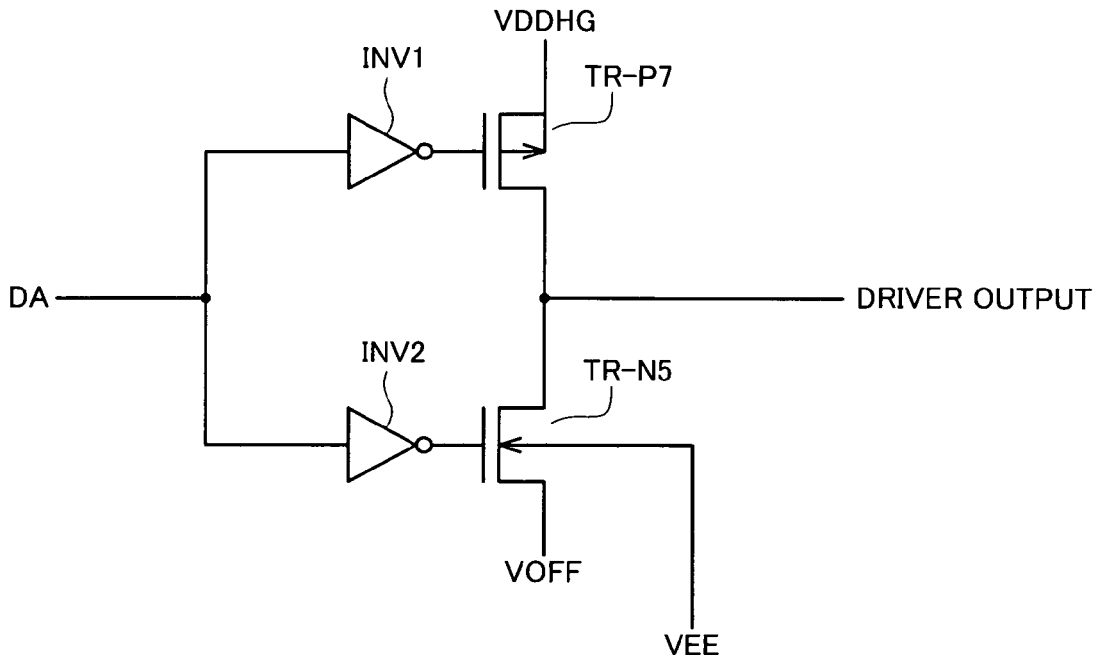
FIG. 7 is a circuit diagram showing the driver in the scan drive cell shown in FIG. 3.

FIG. 7 is a circuit diagram of the driver 423. The driver 423 includes an N-type transistor TR-N5 and a P-type transistor TR-P7. The signal from the second level shifter output O2 is input to a driver input DA. The voltage VDDHG is supplied to a source (or drain) of the P-type transistor TR-P7, and a substrate potential is set at the voltage VDDHG A voltage VOFF is supplied to a source of the N-type transistor TR-N5, and the substrate potential is set at the voltage VEE.

When a signal at the voltage VDDHG is input to the driver input DA from the second level shifter output O2, the signal is reversed by an inverter INV1, whereby the P-type transistor TR-P7 is turned ON. This causes a signal at the voltage VDDHG to be output from the driver output QA between the source and drain of the P-type transistor TR-P7. The N-type transistor TR-N5 remains in the OFF state. In this case, the signal at the voltage VDDHG input to the driver input DA is reversed by an inverter INV2, and is input to the gate of the N-type transistor TR-N5. However, since the substrate potential of the N-type transistor TR-N5 is set at VEE, the gate threshold of the N-type transistor TR-N5 is high. Therefore, the N-type transistor TR-N5 can be securely turned OFF.

When a signal at the voltage VEE is input to the driver input DA from the second level shifter output O2, the signal is reversed by the inverter INV2, whereby the N-type transistor TR-N5 is turned ON. This causes a signal at the voltage VOFF to be output from the driver output QA between the source and drain of the N-type transistor TR-N5. The P-type transistor TR-P7 remains in the OFF state.

6. Operations of Scan Driver

Figure 8:
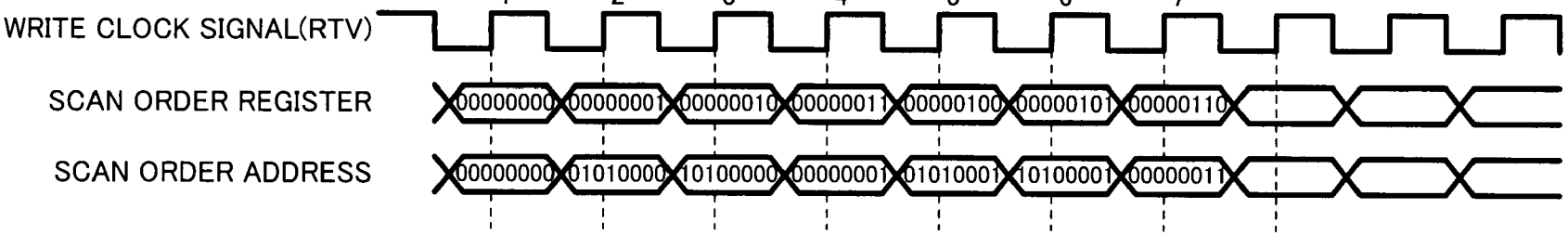
FIG. 8 is a timing chart when writing a scan order address into the scan order register shown in FIG. 3.

The operations of the scan driver 400 is described below with reference to FIGS. 8 and 9. FIG. 8 is a timing chart when writing the scan order address into the scan order register 460, and shows an interlaced drive (two-line skip).

The scan order address bus 480 is selected by the selector 450 shown in FIG. 3 at the time of initialization (at the time of power on, for example). The write clock signal RTV is input to the scan order register 460 from an external control circuit (driver controller 600, for example). The scan order address supplied from the scan order address bus 480 is sequentially written into each of the scan order registers 460 in synchronization with the rising edge of the write clock signal RTV. In FIG. 8, (00000000) is written into the first scan order register 460 as the scan order address at the rising edge of the write clock signal RTV. The scan line address (01010000) is written into the second scan order register 460 at the next rising edge of the write clock signal RTV. The scan line address (10100000) is written into the third scan order register 460, and the scan line address (00000001) is written into the fourth scan order register 460.

Specifically, the order of driving each of the scan lines 40 is written into each of the corresponding scan order registers 460. In the interlaced drive (two-line skip) shown in FIG. 8, the scan line address is written into each of the scan order registers 460 so that the first scan order register 460 is select-driven and the fourth scan order register 460 is then select-driven by omitting two lines.

Figure 9:
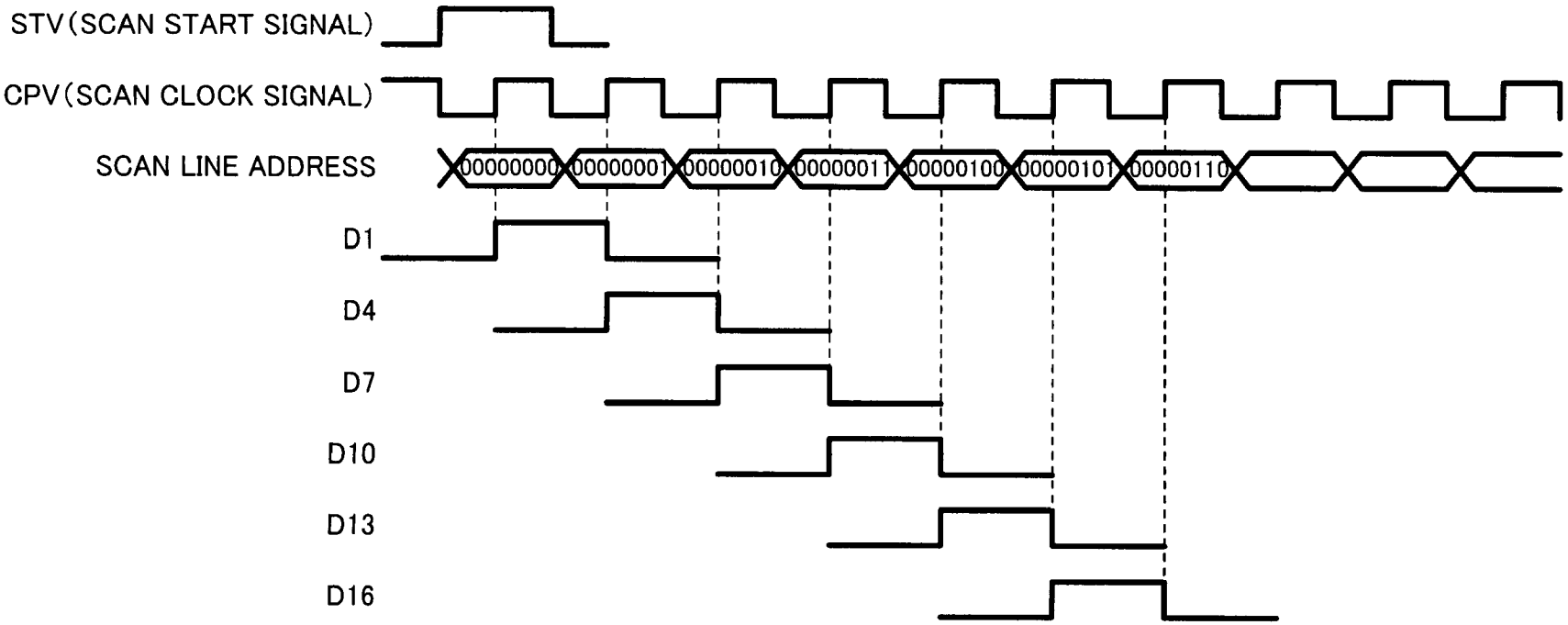
FIG. 9 is a timing chart when driving the scan line shown in FIG. 3.

FIG. 9 shows a timing chart when driving each of the scan lines 40 in the case where the scan line address is written as shown in FIG. 8. A scan start signal STV is input to the display driver 300 from an external control circuit (driver controller 600, for example). Reading of data is started in synchronization with the rising edge of the scan start signal STV. In this embodiment, the scan start signal STV rises in units of one frame. However, the scan start signal STV may be supplied so as to rise in units of N frames (N is an integer of one or more).

The scan clock signal CPV is supplied to the display driver 300 from an external control circuit (driver controller 600, for example) in response to the rising edge of the scan start signal STV. Each of the scan order registers 460 supplies the scan order address stored therein to the coincidence detection circuit 410 in synchronization with the rising edge of the scan clock signal CPV. The scan line address is supplied to the coincidence detection circuit 410 from the scan line address bus 470 in synchronization with the rising edge of the scan clock signal CPV. Each of the coincidence detection circuits 410 compares the scan line address and the scan order address supplied thereto. The scan drive cell connected with the coincidence detection circuit 410 in which the scan line address coincides with the scan order address as a result of comparison ON-drives the scan line 40. The scan line address is supplied to the selector 450 from the scan line address bus 470 while being sequentially incremented (or decremented). In FIG. 9, the driver output D4 rises to the high level after the driver output D1 has risen to the high level. Subsequently, each output rises in the order of the driver outputs D7, D10, D13, D16 . . . . Specifically, when the scan order address is written into each of the scan order registers 460 as shown in FIG. 8, the scan driver 400 performs the interlaced drive (two-line skip) by allowing the scan line address to be supplied to the selector 450 while being sequentially incremented (or decremented) as shown in FIG. 9.

An escape address is used as a stop mark after driving all the scan lines 40. A value which is not used as the scan order address is used as the escape address. It is possible to prevent the scan drive cells 420 from being select-driven by supplying an 8-bit address "11111111", which is a value that is not used as the scan order address, to the scan line address bus 430, for example.

The above-described example illustrates the interlaced drive (two-line skip). However, this embodiment can easily deal with various drive methods. In order to deal with a desired drive method, the scan order address may be written into each of the scan order registers 460 in the order corresponding to the desired drive method. This makes it possible to deal with the comb-tooth drive or the normal drive (sequential drive), for example.

This is the operation of the scan driver 400 when driving the scan line 40.

7. Effects

When externally supplying data through an interface, a specific amount of electric power is generally consumed each time the data is supplied. The specific amount of electric power contains unnecessary electric power accompanying the use of the interface in comparison with the case where the data is supplied inside the circuit. This power consumption cannot be disregarded if supply is increased.

The display driver 300 in this embodiment is configured to include a plurality of scan order registers 460. In this embodiment, the scan line address is sequentially incremented (or decremented) when supplying the scan line address to the scan line address bus 470. Since this processing is simple and does not require a considerable amount of load, the processing can be performed by the display driver 300. Therefore, since the designation and coincidence detection of the scan line address can be performed by the display driver 300, the scan line 40 can be selected with a reduced power consumption. Since the number of scan lines 40 is increased in the case of driving a high-definition panel, the number the scan line addresses as supplied per second is increased. Therefore, this embodiment which can supply the scan line address with a reduced power consumption is effective.

Moreover, since the processing required for an external control device is reduced, a display device with a very flexible design specification for mounting on a small instrument such as a portable instrument can be provided. It is possible to easily deal with various display panels and scan line drive methods by using this embodiment.

Figure 10:
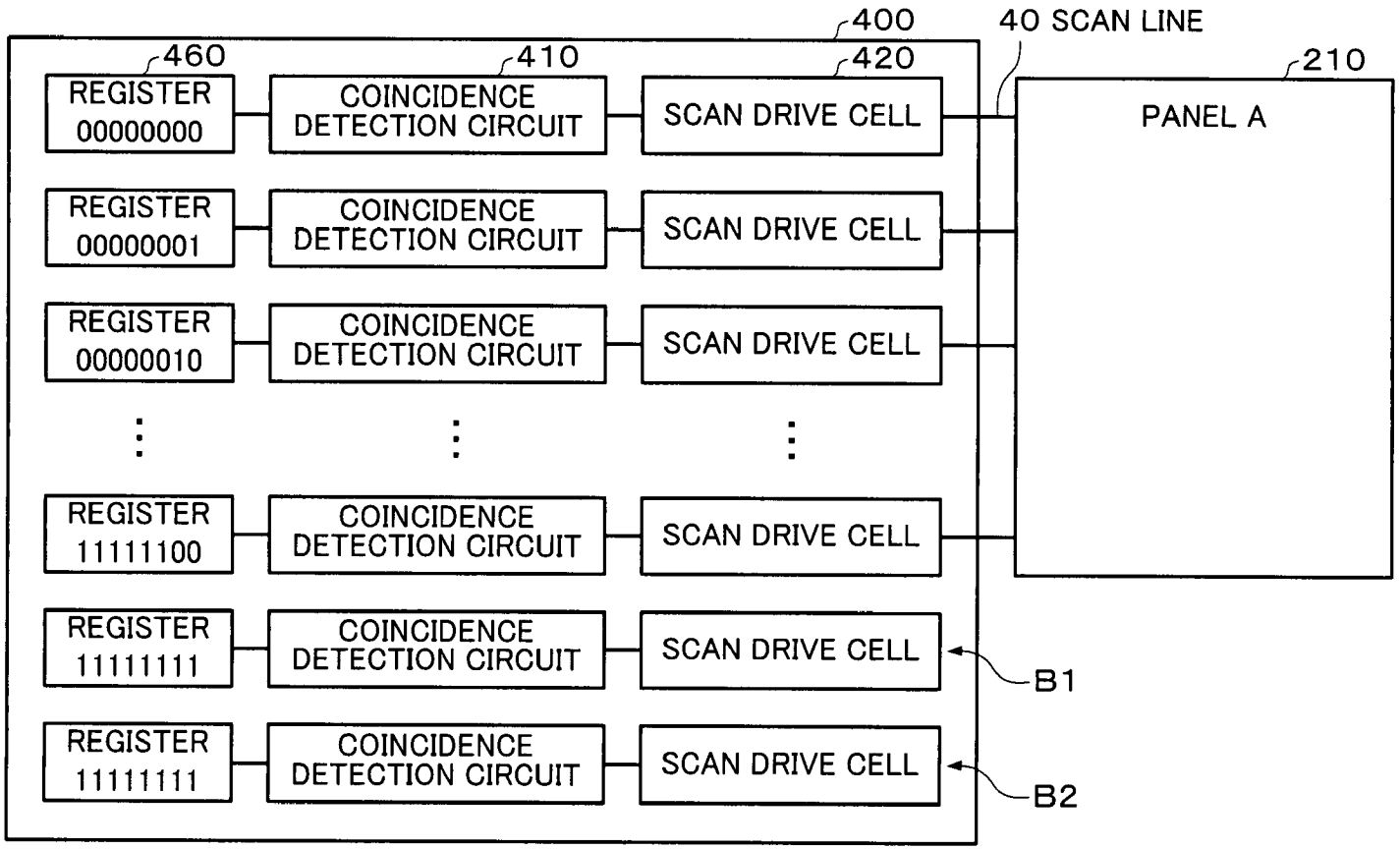
FIG. 10 is a diagram showing the connection of a coincidence detection circuit, a scan drive cell and a panel A, according to one embodiment of the present invention.

FIG. 10 is a diagram showing the scan driver 400 which drives a display panel 210 (hereinafter called "panel A"). The scan driver 400 shown in FIG. 10 includes 255 coincidence detection circuits 410, 255 scan drive cells 420, and 255 scan order registers 460. The range of 8-bit addresses "00000000" to "11111100" is assigned to the scan order registers 460 as the scan order addresses. In FIG. 10, the scan drive cell 420 connected with the scan order register 460 which stores the scan order address "11111111" (B1 in FIG. 10) and the scan drive cell 420 connected with the scan order register 460 which stores the scan order address "11111111" (B2 in FIG. 10) are not connected with the panel A.

Specifically, the number of the scan lines 40 provided in the panel A is smaller than the number of the scan drive cells 420 provided in the scan driver 400. However, since this embodiment uses the escape address during drive, the panel A can be driven without changing the circuit configuration of the scan driver 400. The scan line address bus 470 supplies "11111100", which is the final address connected with the panel A, to the scan driver 400, and then supplies the escape address ("11111101", for example) to the scan driver 400. This enables the scan driver 400 in this embodiment to drive the panel A.

Figure 11:
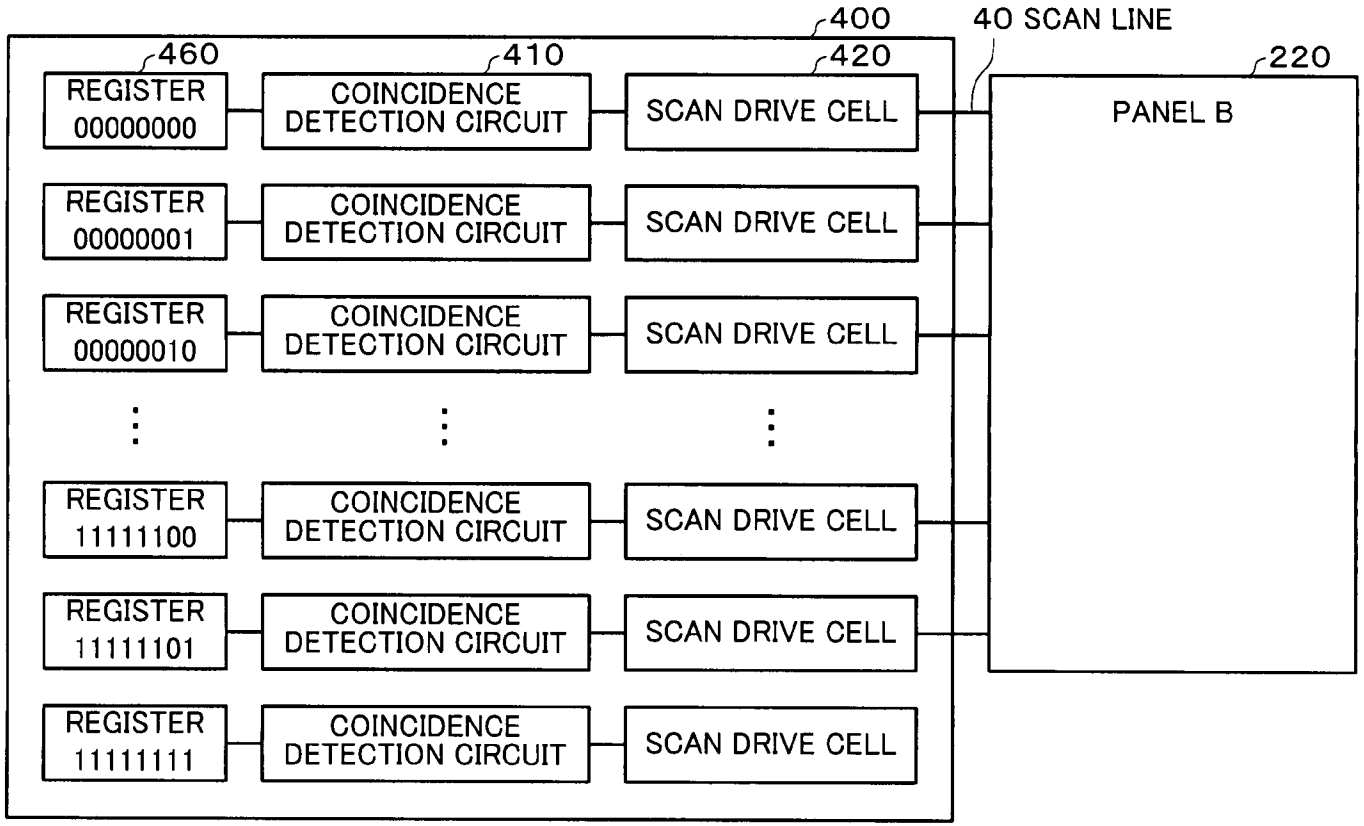
FIG. 11 is a diagram showing the connection of a coincidence detection circuit, a scan drive cell and a panel B according to one embodiment of the present invention.

FIG. 11 is a diagram showing the scan driver 400 which drives a display panel 220 (hereinafter called "panel B"). In this case, the scan line address bus 470 supplies "11111101", which is the final address connected with the panel B, to the scan driver 400, and then supplies the escape address ("11111110", for example) to the scan driver 400 at the time of scan drive. This enables the scan driver 400 in this embodiment to drive the panel B.

The scan driver 400 can be utilized for various display panels by setting the scan line address supplied from the scan line address bus 470 at the escape address as described above.

Figure 12:
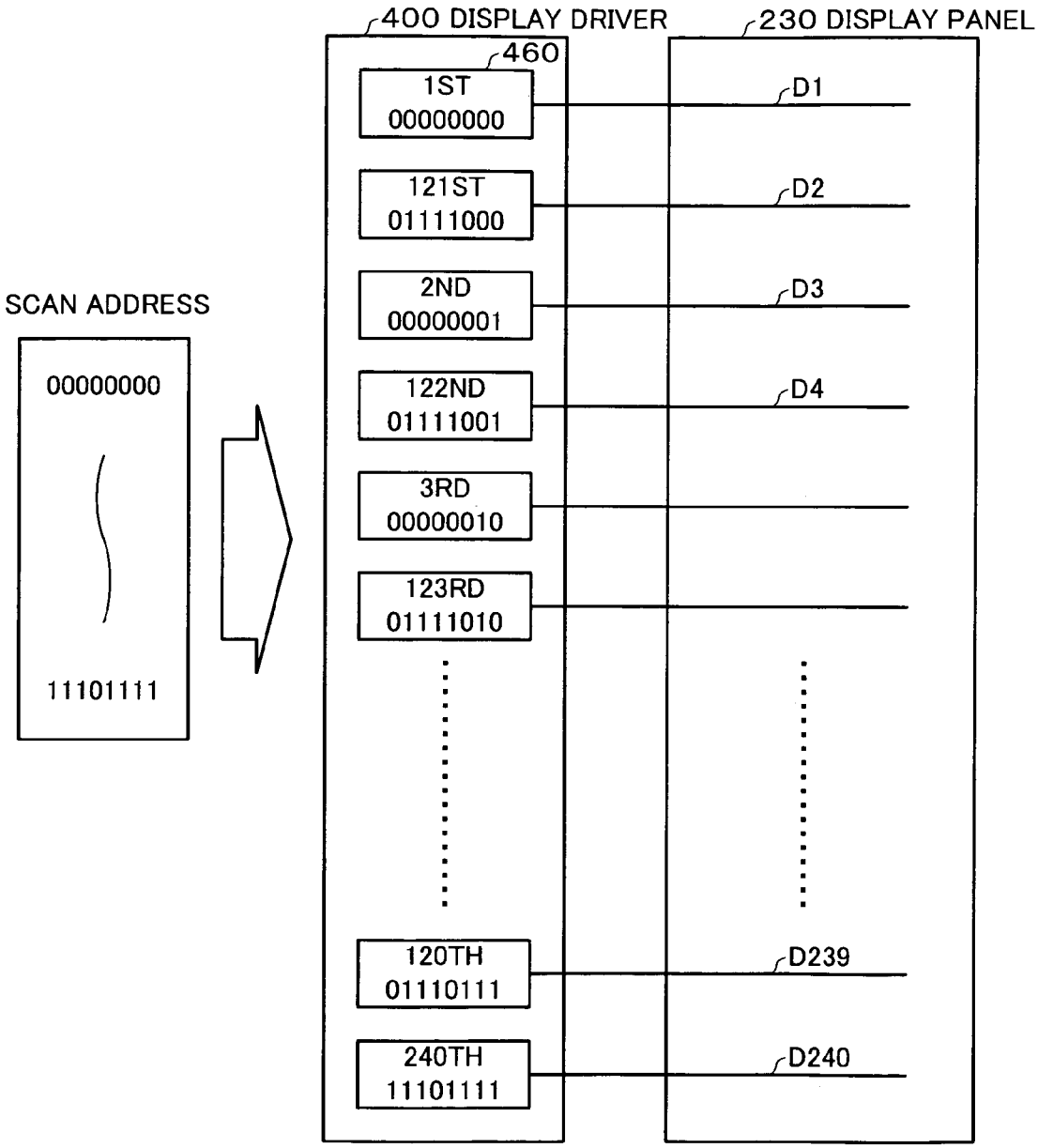
FIG. 12 is a diagram showing an interlaced drive (one-line skip).

FIG. 12 shows an interlaced drive (one-line skip). The interlaced drive (one-line skip) can be performed by storing the scan order address in each of the scan order registers 460 as shown in FIG. 12. When the scan line address is supplied to each of the coincidence detection circuits 410 from the scan line address bus 470 while being sequentially incremented, the scan line 40 corresponding to the first scan order register 460 (which stores "00000000") is driven by the driver output D1. The scan line 40 corresponding to the second scan order register 460 (which stores "00000001") is then driven by the driver output D3. The scan lines 40 are driven in the order of the driver outputs D1, D3, . . . , D239, D2, D4, . . . , and D240 according to FIG. 12. This enables the interlaced drive (one-line skip).

Figure 13:
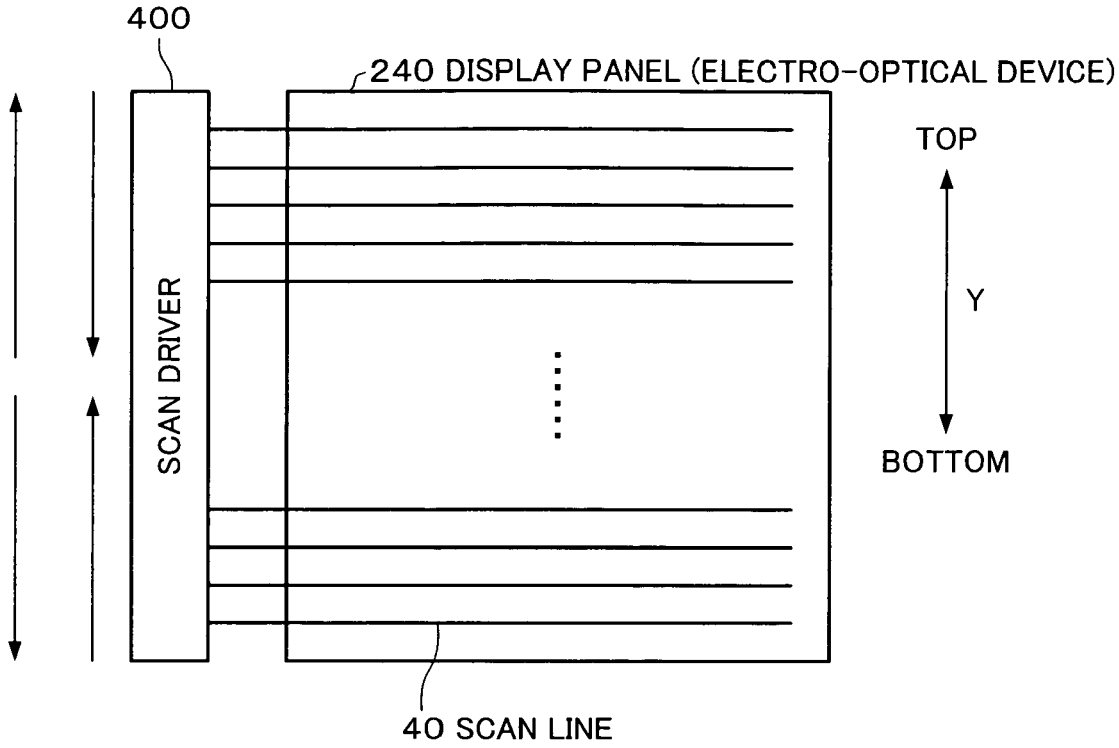
FIG. 13 is a diagram showing a comb-tooth drive.

FIG. 13 is illustrative of a comb-tooth drive. In the normal drive, the scan lines 40 are sequentially driven from the top to the bottom along the column direction Y shown in FIG. 13. In the comb-tooth drive, the scan lines 40 are simultaneously ON-driven toward the center from each end. Specifically, the uppermost scan line 40 in the column direction Y is ON-driven and the lowermost scan line 40 in the column direction Y is ON-driven. The scan lines 40 are then sequentially ON-driven toward the center from each end. The comb-tooth drive method also includes the case where the scan lines 40 are ON-driven from the center toward each end along the column direction Y.

Figure 14:
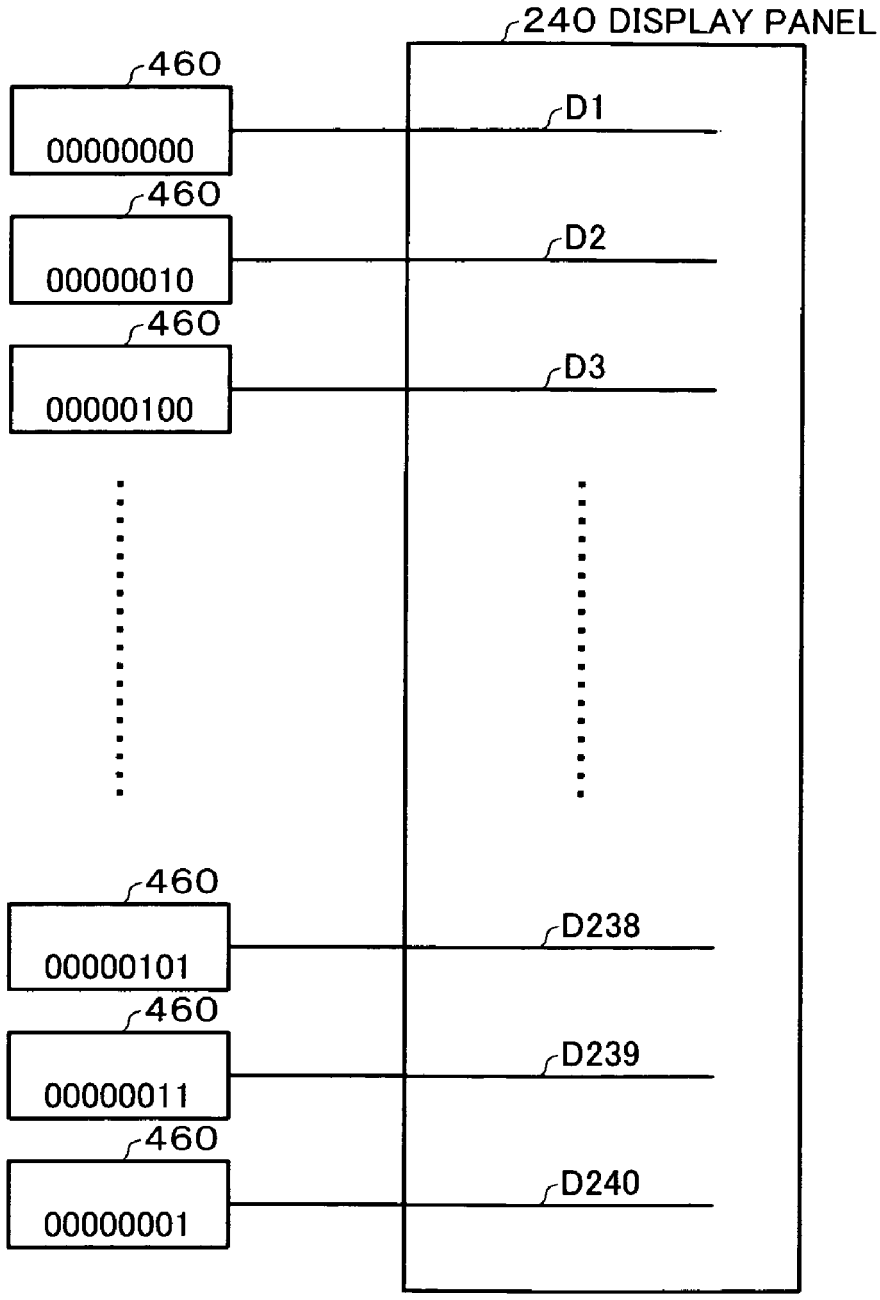
FIG. 14 is a diagram showing another comb-tooth drive.

In this embodiment, since it suffices to store the scan order address in each of the scan order registers 460 according to the order of the scan lines 40 to be driven, it is possible to deal with the comb-tooth drive. FIG. 14 shows the comb-tooth drive in which the scan lines 40 are scanned toward the center from the upper and lower sides, for example.

The scan order address is stored in each of the scan order registers 460 shown in FIG. 14 in the order of (00000000), (00000010), . . ., (00000100), (00000101), (00000011), and (00000001) from the top. The comb-tooth drive can be realized by causing the scan line address to be supplied to a scan driver 400 from the scan line address bus 470 while being sequentially incremented.

Conventionally, it is necessary to separately provide a logic circuit for the interlaced drive or the comb-tooth drive to the scan driver 400. Moreover, it is necessary to form a complicated logic circuit in order to deal with all of the normal drive, interlaced drive, and comb-tooth drive.

Since these embodiments of the present invention can deal with various drive methods without using such a complicated circuit, the manufacturing cost can be reduced and versatility can be increased.

The present invention is not limited to the above embodiments, and various modifications and variations are possible within the spirit and scope of the present invention. For example, the configuration of the coincidence detection circuit is not limited to the configuration shown in FIG. 4. A circuit configuration logically equivalent to the configuration shown in FIG. 4 may be employed. The configuration of the scan drive cell is not limited to the configuration described with reference to FIGS. 5 to 7. For example, the number of level shifters may be one.

The above embodiments illustrate an example in which the present invention is applied to an active matrix type liquid crystal device. However, the present invention may be applied to a simple matrix liquid crystal device or the like. The present invention may also be applied to an electro-optical device (organic EL device, for example) other than the liquid crystal device.

What is claimed is:

1. A display driver which drives at least a plurality of scan lines of a display panel which has a plurality of data lines and a plurality of pixels in addition to the scan lines, the display driver comprising:

a plurality of scan drive cells;

a plurality of scan order registers; and a plurality of coincidence detection circuits, each of the plurality of scan order registers being connected to one of the plurality of coincidence detection circuits, each of the plurality of scan order registers storing a scan order address which is used to show a scan order, each of the plurality of coincidence detection circuits being connected to one of the plurality of scan drive cells, each of the plurality of coincidence detection circuits outputting to one of the plurality of scan drive cells a result of comparison between the scan order address stored in the one of the plurality of scan order registers and a scan line address designated by a scan control signal, and each of the plurality of scan drive cells driving one of the plurality of scan lines.

2. The display driver as defined in claim 1, further comprising:

a scan line address bus used to supply the scan line address; and a scan order address bus used to supply the scan order address to each of the plurality of scan order registers.

3. The display driver as defined in claim 2, each of the plurality of scan order registers storing the scan order address from the scan order address bus, based on a write clock signal.

4. The display driver as defined in claim 2, further comprising:

a plurality of selectors each of which is connected to one of the plurality of scan order registers, each of the plurality of selectors selecting the scan order address bus from among the scan order address bus and the scan line address bus, and outputting the scan order address from the selected scan order address bus to one of the plurality of scan order registers connected to one of the plurality of selectors when storing the scan order address in the one of the plurality of scan order registers.

5. The display driver as defined in claim 1, when one of the plurality of coincidence detection circuits determines that the scan line address coincides with the scan order address, one of the plurality of scan drive cells connected to the one of the plurality of coincidence detection circuits driving one of the plurality of scan lines connected to the one of the plurality of scan drive cells.

6. An electro-optical device comprising:

the display driver as defined in claim 5;

a display panel driven by the display driver; and a controller which controls the display driver.

7. The display driver as defined in claim 1, the scan line address being set to an address other than the scan order address when none of the plurality of scan lines are selected.

8. An electro-optical device comprising:

the display driver as defined in claim 7;

a display panel driven by the display driver; and a controller which controls the display driver.

9. The display driver as defined in claim 1, the scan order addresses being sequentially stored into the plurality of scan order registers; and the plurality of scan lines being sequentially driven by incrementing or decrementing the scan line addresses.

10. An electro-optical device comprising:

the display driver as defined in claim 9;

a display panel driven by the display driver; and a controller which controls the display driver.

11. The display driver as defined in claim 1, the scan order addresses being stored into the plurality of scan order registers in an order corresponding to a scan order for interlaced driving; and the plurality of scan lines being interlaced-driven by incrementing or decrementing the scan line addresses.

12. An electro-optical device comprising:

the display driver as defined in claim 11;

a display panel driven by the display driver; and a controller which controls the display driver.

13. The display driver as defined in claim 1, the scan order address being stored into the plurality of scan order registers in an order corresponding to a scan order for comb-tooth driving; and the plurality of scan lines being comb-tooth driven by incrementing or decrementing the scan line addresses.

14. An electro-optical device comprising:

the display driver as defined in claim 13;

a display panel driven by the display driver; and a controller which controls the display driver.

15. The display driver as defined in claim 1, each of the plurality of coincidence detection circuits having at least one of an output enable input and an output fix input;

each of the plurality of coincidence detection circuits ON-driving one of the plurality of scan drive cells connected to one of the plurality of coincidence detection circuits in a period in which an active signal is input to the output fix input of the one of the plurality of coincidence detection circuits; and each of the plurality of coincidence detection circuits OFF-driving one of the plurality of scan drive cells connected to one of the plurality of coincidence detection circuits in a period in which a non-active signal is input to the output enable input of the one of the plurality of coincidence detection circuits.

16. An electro-optical device comprising:

the display driver as defined in claim 15;

a display panel driven by the display driver; and a controller which controls the display driver.

17. An electro-optical device comprising:

the display driver as defined in claim 1;

a display panel driven by the display driver; and a controller which controls the display driver.

18. A method of driving at least a plurality of scan lines of a display panel by using a plurality of scan drive cells, the display panel having a plurality of data lines and a plurality of pixels in addition to the plurality of scan lines, the method comprising:

designating a scan line address by a scan control signal;

storing a scan order address which is used to show a scan order in each of a plurality of scan order registers;

comparing the scan order address with the scan line address, and outputting the comparison result to the plurality of scan drive cells; and driving the plurality of scan lines by the plurality of scan drive cells, the comparison between the scan order address and the scan line address being done by a plurality of coincidence detection circuits; and when one of the plurality of coincidence detection circuits determines that the scan line address coincides with the scan order address, one of the plurality of scan drive cells connected to the one of the plurality of coincidence detection circuits driving one of the plurality of scan lines connected to the one of the plurality of scan drive cells.

19. The drive method as defined in claim 18, the scan line address being set to an address other than the scan order address when none of the plurality of scan lines are selected.

* * * * *